US011649089B2

(12) United States Patent
Calhoun

(10) Patent No.: US 11,649,089 B2
(45) Date of Patent: May 16, 2023

(54) COLLAPSIBLE SNACK CADDY

(71) Applicant: Sondra Calhoun, Midland, GA (US)

(72) Inventor: Sondra Calhoun, Midland, GA (US)

( * ) Notice: Subject to any disclaimer, the term of this patent is extended or adjusted under 35 U.S.C. 154(b) by 0 days.

(21) Appl. No.: 17/360,231

(22) Filed: Jun. 28, 2021

(65) Prior Publication Data

US 2022/0002031 A1 Jan. 6, 2022

Related U.S. Application Data

(60) Provisional application No. 63/047,007, filed on Jul. 1, 2020.

(51) Int. Cl.

| | |
|---|---|
| ***B65D 21/032*** | (2006.01) |
| ***B65D 25/28*** | (2006.01) |
| ***B65D 6/18*** | (2006.01) |
| *A47G 23/06* | (2006.01) |

(52) U.S. Cl.

CPC ..... *B65D 25/2873* (2013.01); *B65D 11/1833* (2013.01); *B65D 25/2835* (2013.01); *A47G 23/0616* (2013.01)

(58) Field of Classification Search

CPC . B65D 11/186; B65D 11/1833; B65D 11/184; B65D 11/1846; B65D 11/1853

See application file for complete search history.

(56) References Cited

U.S. PATENT DOCUMENTS

| | | | | |
|---|---|---|---|---|
| 5,524,814 | A * | 6/1996 | Davis | A47G 23/06 229/117.26 |
| 9,527,626 | B1 * | 12/2016 | Coronado | B65D 11/186 |
| 2007/0241174 | A1 * | 10/2007 | Turvey | B65D 43/0218 229/117.03 |
| 2019/0269230 | A1 * | 9/2019 | Powell | B62J 9/27 |
| 2021/0261295 | A1 * | 8/2021 | Song | B65D 25/20 |

* cited by examiner

*Primary Examiner* — Stephen J Castellano

(74) *Attorney, Agent, or Firm* — Smith Gambrell & Russell LLP

(57) ABSTRACT

A collapsible snack caddy has an open rectangular box-like configuration for carrying snacks and a closed flat configuration. The caddy has a bottom, front and back sides, left and right ends, and an open top. The caddy is hinged at all four corners. The sides and ends are hinged to the bottom. The sides have diagonal living hinges to allow a triangular portion to fold upon the trapezoidal portion. The bottom, and both sides are hinged in the middle so that opposite portions of the ends, sides, and the bottom can fold upon each other.

9 Claims, 16 Drawing Sheets

COLLAPSIBLE SNACK CADDY

CROSS REFERENCE TO RELATED PATENT APPLICATIONS

This patent application claims priority from U.S. Provisional Patent Application No. 63/047,007, filed Jul. 1, 2020, which is hereby incorporated by reference.

FIELD OF THE INVENTION

This invention relates to a collapsible snack caddy for transporting snacks and drink cups.

BACKGROUND OF THE INVENTION

When attending a movie, concert, or a sporting event, a customer often purchases snacks or drinks to consume during the movie, concert, or sporting event. Typically, the snacks and drinks must be transported from a concession stand to the customer's seat. In managing snacks, drinks, and tickets, the customer may have difficulty where multiple snacks and drinks have been purchased. Further, the customer may have to produce tickets for inspection by ushers in order to have access to the designated seat on the tickets. Consequently, the customer needs a way to keep snacks, drinks, and tickets all together in one place for easy transport and access.

SUMMARY OF THE INVENTION

The collapsible snack caddy of the present invention overcomes the problem of managing snacks, drinks, and tickets at a theater, concert, or a sporting event. Particularly, the present invention is a collapsible snack caddy. When in an open configuration, the snack caddy forms a rectangular box-like structure with a height, a width, and a length. The snack caddy has a front side, a back side, left and right ends, a bottom, and an open top. The height of the sides and ends define the height of the snack caddy. The width of the ends defines the width of the snack caddy. The length of the sides defines the length of the snack caddy. Further, the snack caddy has one or more horizontally oriented drink cup straps extending across one or more of the inside corners of the box-like structure to secure drink cups to the adjacent side an end with of the corner.

The snack caddy is hinged at all four corners where the front side, the left end, the back side, and the right end are joined in sequence. In addition, the front side, left end, back side, and right end are hinged to the bottom of the snack caddy. The front side is divided into a rectangular left section and a rectangular right section connected together by a hinged center connector. Similarly, the back side is divided into a rectangular left section and a rectangular right section connected together by a hinged center connector.

The front left section and the front right section are further divided by a diagonal living hinge that divides each section into a trapezoid and a triangle. The back left section and the back right section are similarly divided by diagonal living hinge into a trapezoid and a triangle.

The bottom is divided into a left bottom panel and a right bottom panel connected by a hinged bottom center connector. A pocket is provided on the exterior surface of the bottom of the snack caddy to hold tickets, cell phone, or other flat objects when the snack caddy is in its folded flat configuration. Foldable handles are attached to each of the ends to facilitate carrying the snack caddy when filled with snacks and/or drinks.

The snack caddy as configured can be collapsed from the box-like configuration to a folded flat configuration when not in use to carry drinks and snacks. The front side and the back side fold inwardly along the diagonal hinges as the ends are simultaneously folded inward until the front side, the back side, and the ends lie flat on the bottom. The bottom, the front side, and the back side are then folded along the center connectors, and the snack caddy is retained in its flat position by a closure mounted on the external sides of the ends.

A shoulder strap can be releasably attached to the exposed exterior surface of the bottom so that the collapsed snack caddy can be easily carried when not in use.

Further objects, features and advantages will become apparent upon consideration of the following detailed description of the invention when taken in conjunction with the drawings and the appended claims.

DETAILED DESCRIPTION OF THE PREFERRED EMBODIMENT

[Terms Used as Identifiers]

Figure 14:
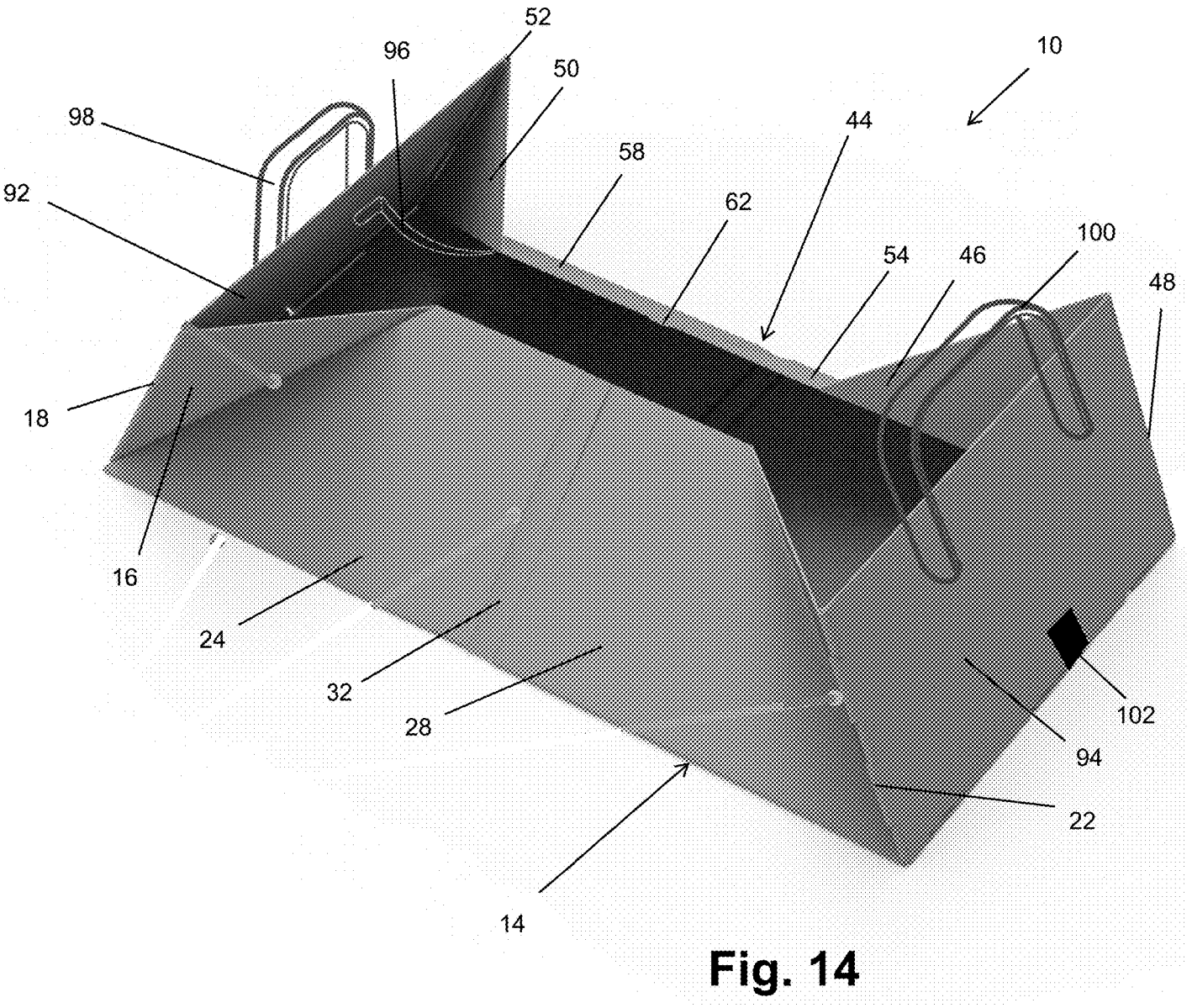
FIG. 14 is a front perspective view of the snack caddy partially folded (without a shoulder strap) in accordance with the present invention.
Figures 15A, 15B, 15C, 15D, 15E, 15F:
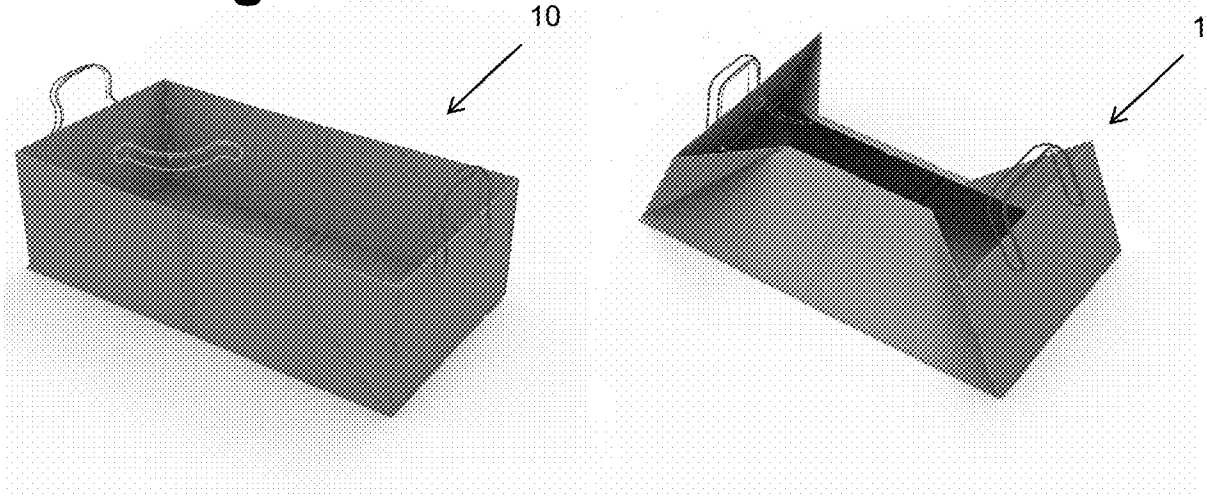
FIGS. 15*a*-15*f* are a front perspective views of the snack caddy showing the progressive steps as the snack caddy is folded from an open configuration in FIG. 15*a* to a flat configuration in FIG. 15*f* in accordance with the present invention.
Figure 16:
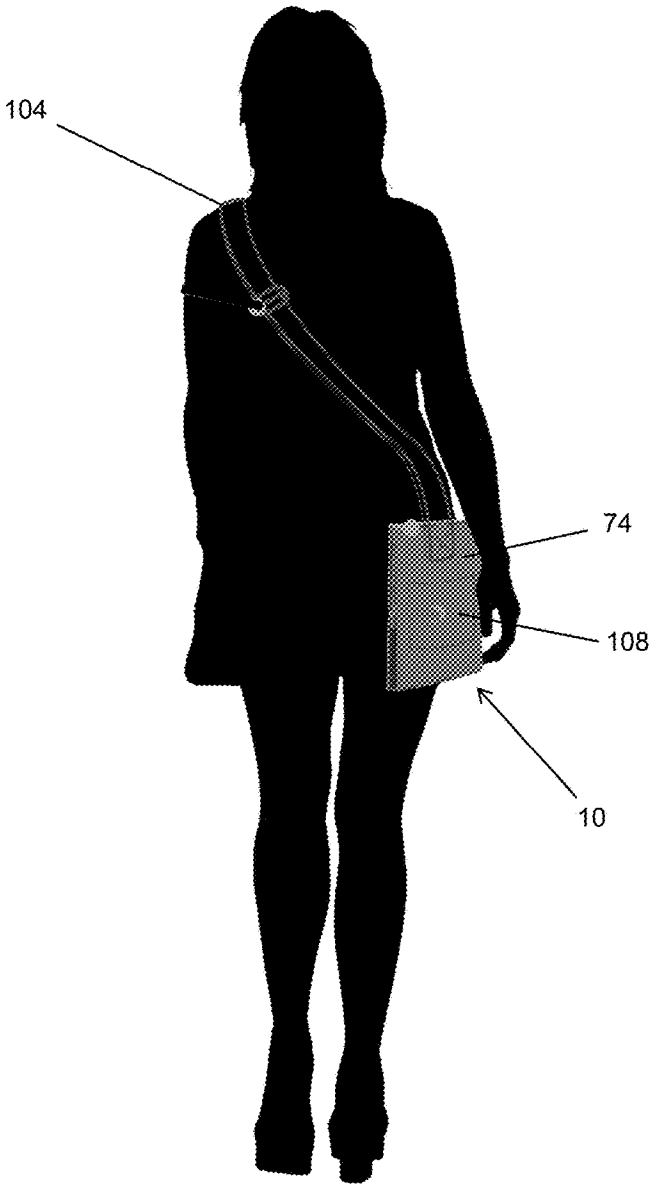
FIG. 16 is an image of the snack caddy in its folded configuration in accordance with the present invention.

A collapsible snack caddy 10 of the present invention overcomes the problem of managing snacks, drinks, and tickets at a theater, concert, or a sporting event. FIGS. 1-11 and 13 show the collapsible snack caddy 10 in its open box-like configuration. FIGS. 14, 15*f*, and 16 show the collapsible snack caddy 10 in its closed flat configuration.

Figure 7:
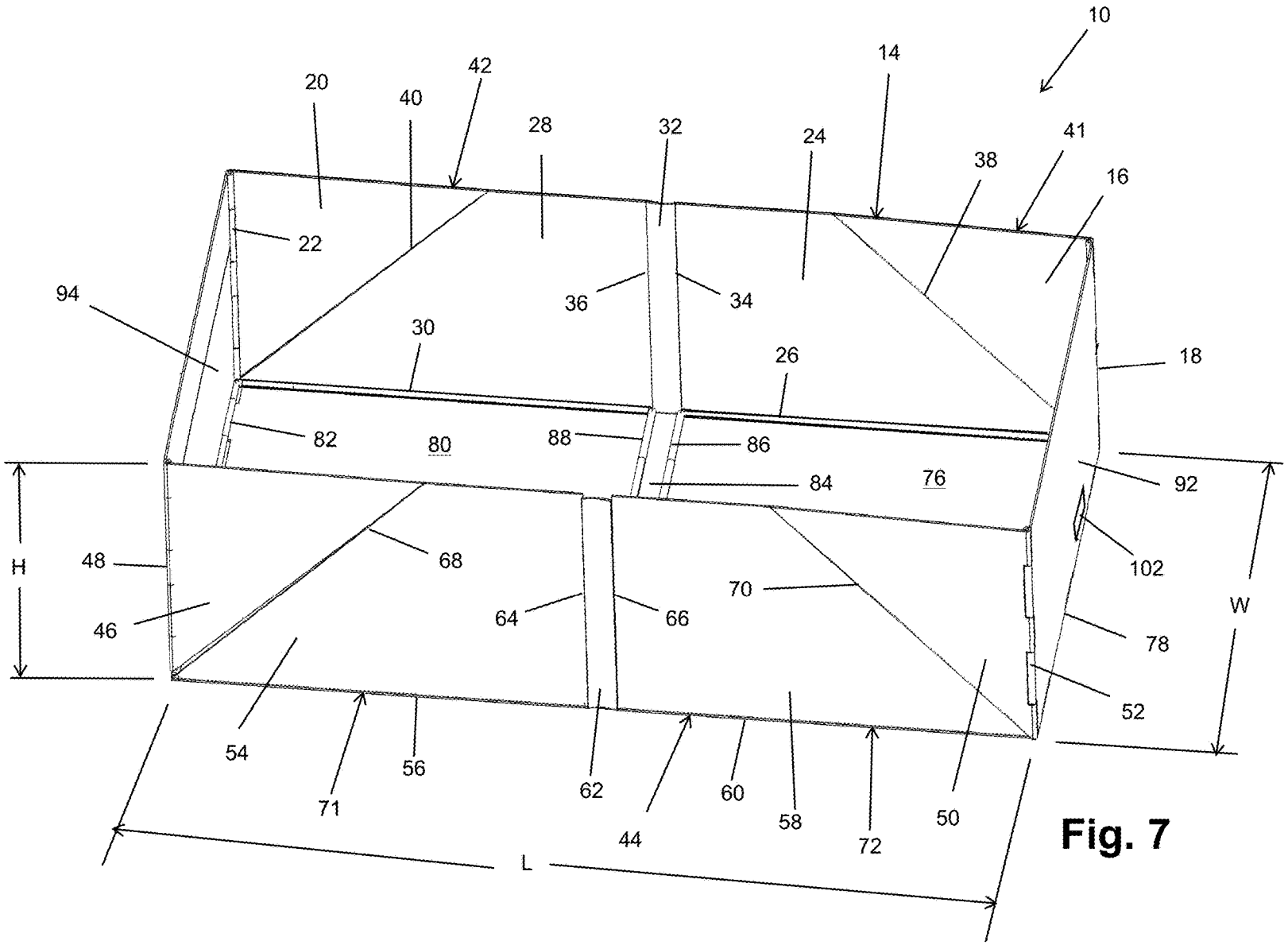
FIG. 7 is an enlarged back perspective view of the snack caddy (without a cup strap, carrier handles, or a shoulder strap) in accordance with the present invention.
Figure 8:
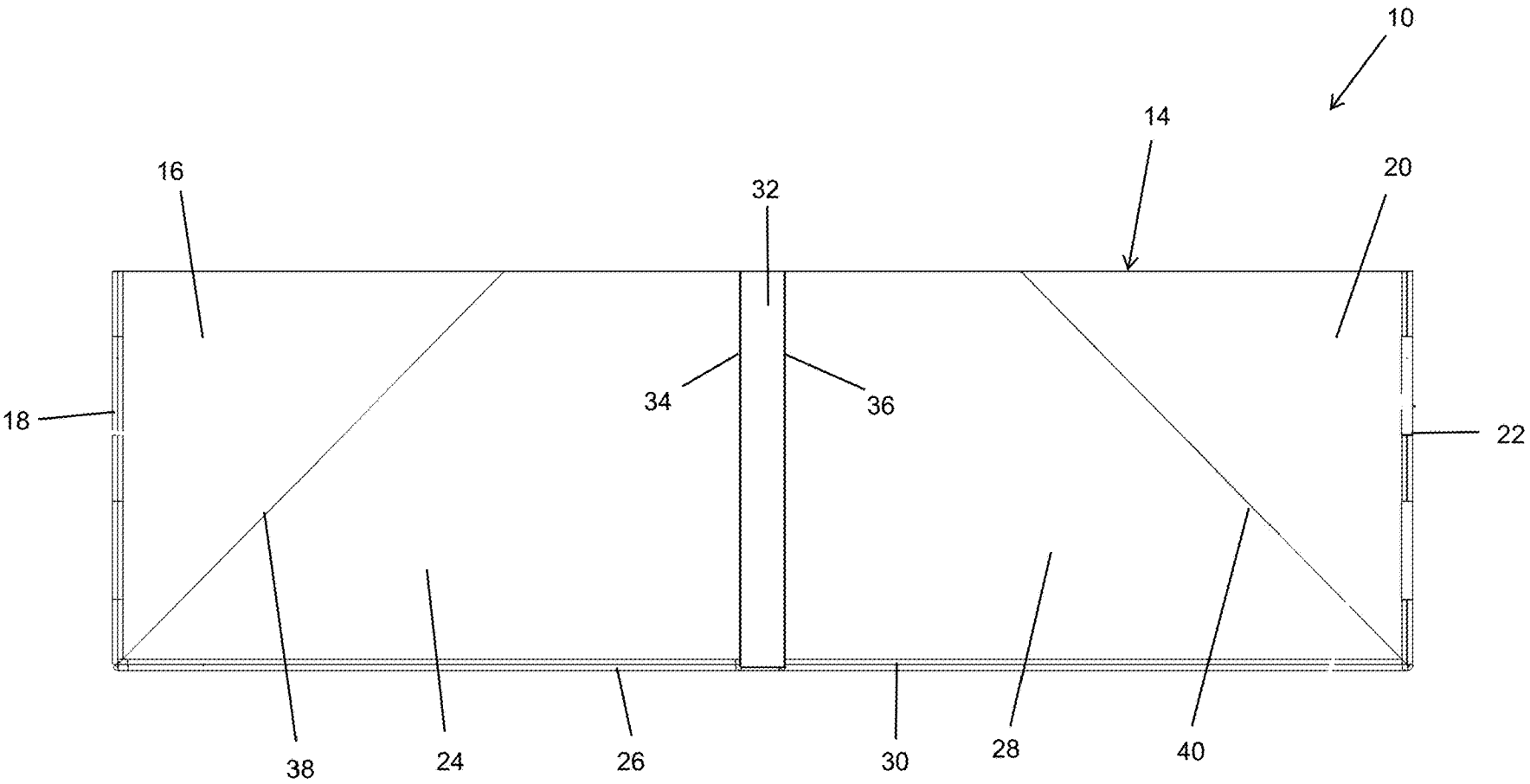
FIG. 8 is a front elevation view of the snack caddy (without a cup strap, carrier handles, or a shoulder strap) in accordance with the present invention.
Figure 9:
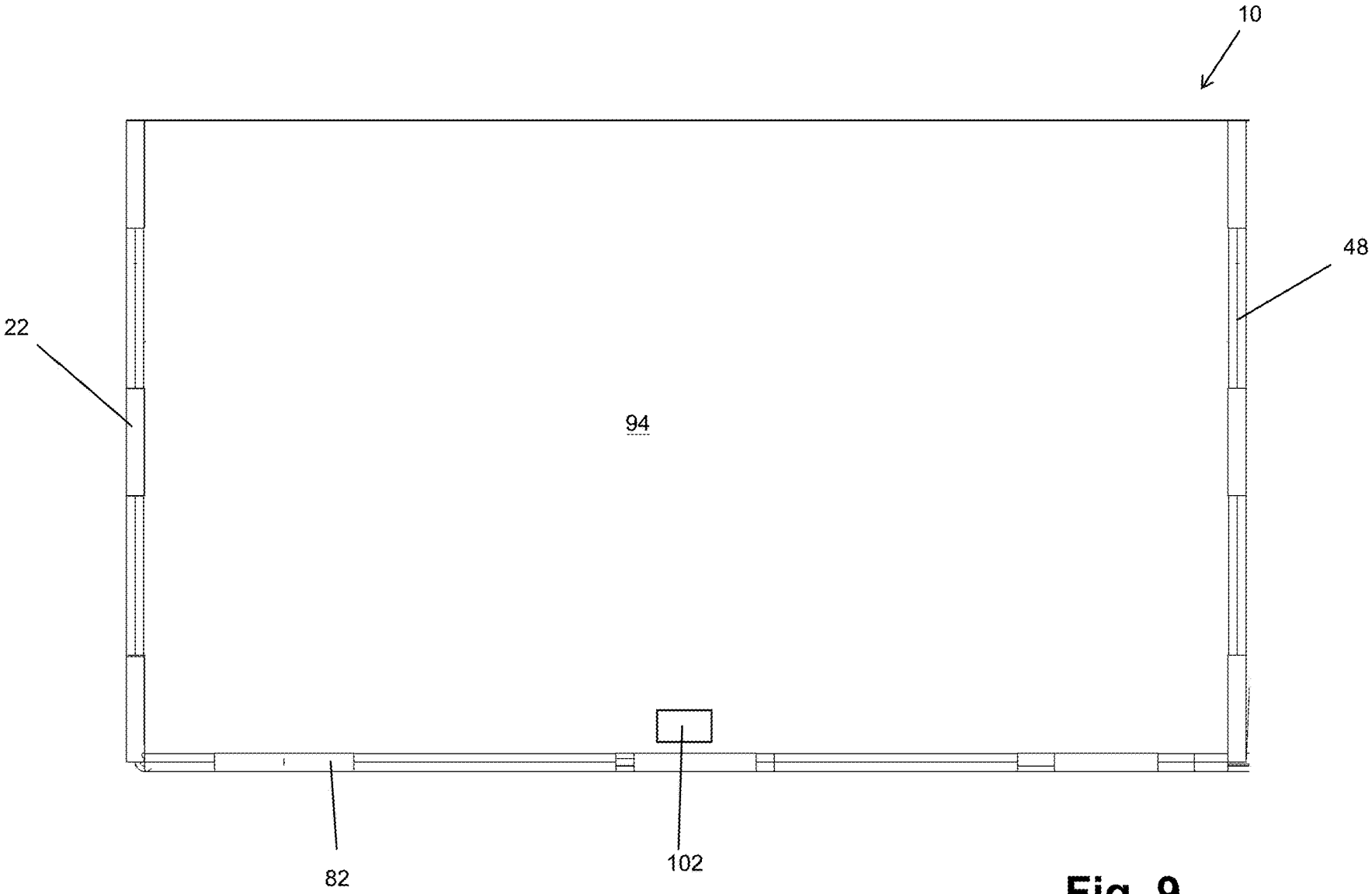
FIG. 9 is a right end elevation view of the snack caddy (without a cup strap, carrier handles, or a shoulder strap) in accordance with the present invention.
Figure 10:
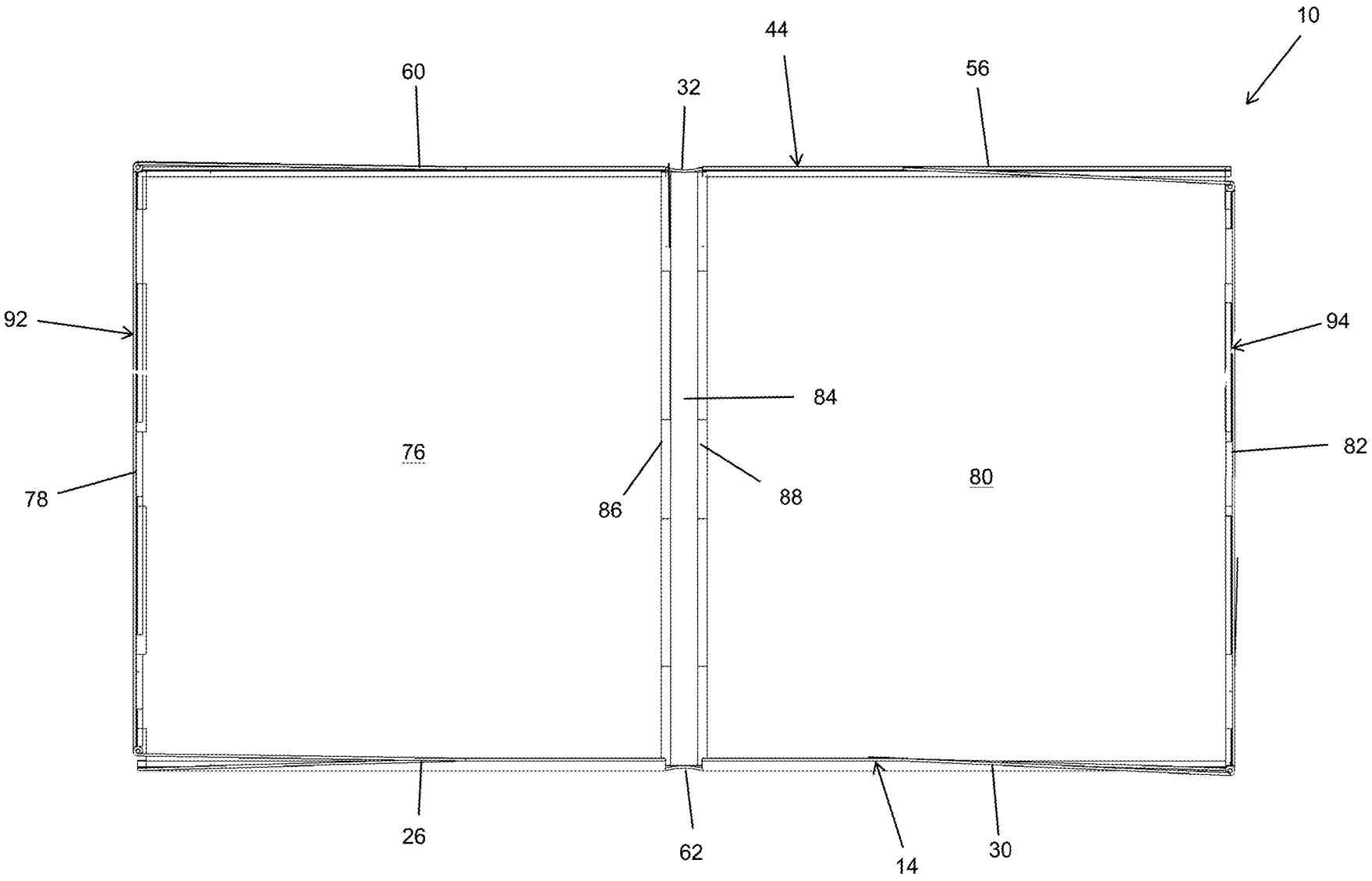
FIG. 10 is a top plan view of the snack caddy (without a cup strap, carrier handles, or a shoulder strap) in accordance with the present invention.
Figure 11:
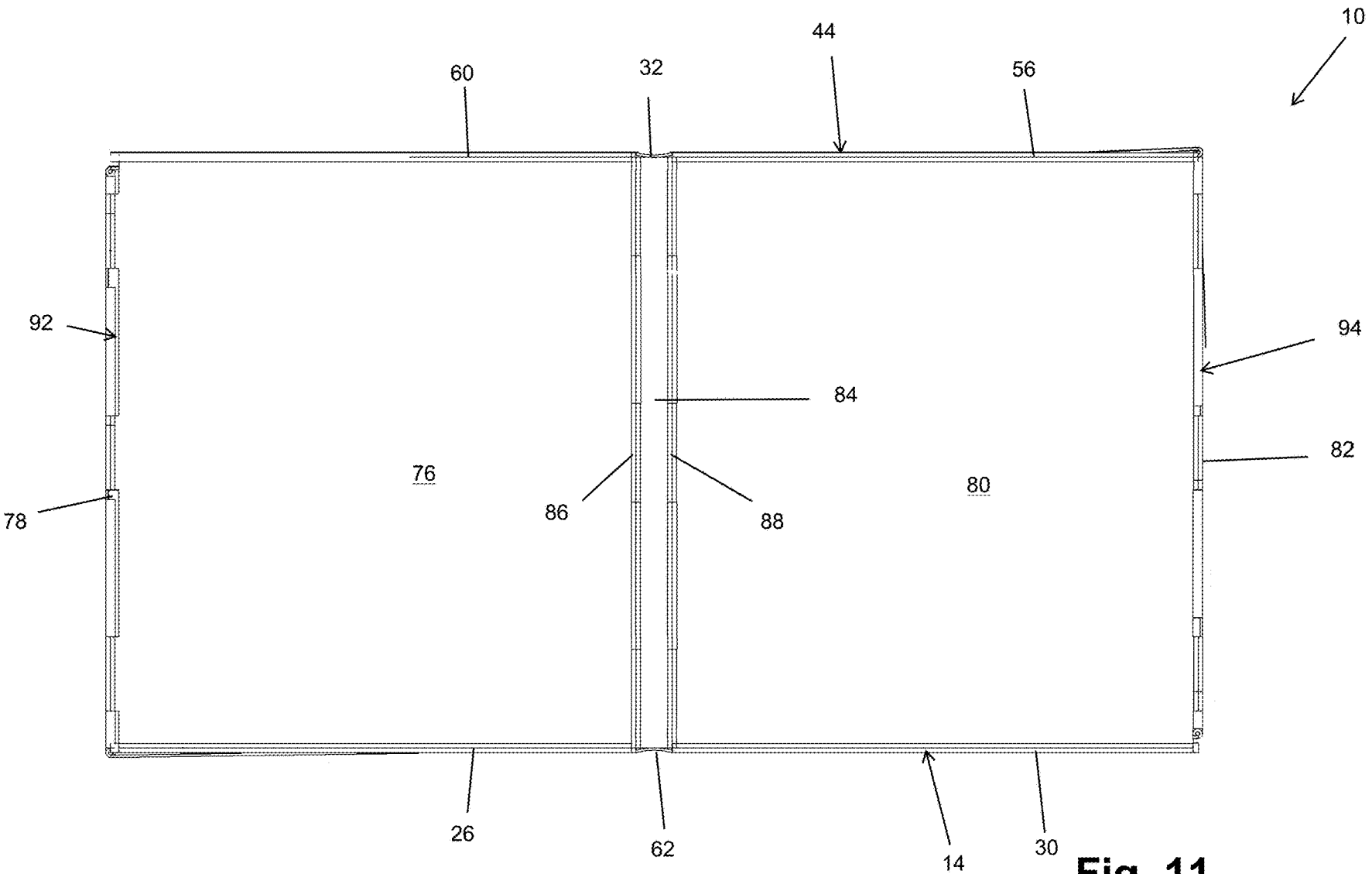
FIG. 11 is a bottom plan view of the snack caddy (without a shoulder strap) in accordance with the present invention.

With reference to FIGS. and 1-11 and 13, the collapsible snack caddy 10, in the open configuration, constitutes a rectangular box-like structure with a length L, a width W, and a height H (FIG. 7). The collapsible snack caddy 10 has a front side 14, a back side 44, a left end 92, a right end 94, and a bottom 74, which together defining an inside volume. The collapsible snack caddy 10 has an open top. The front side 14, the right end 94, the back side 44, and the left end 92 of the collapsible snack caddy 10 are joined in sequence at all four corners by left front corner hinge 18, right front corner hinge 22, right back corner hinge 48, and left back corner hinge 52. In addition, the front side 14, the left end 92, the back side 44, and the right end 94 are hinged to the bottom 74 of the collapsible snack caddy 10 by left front bottom hinge 26, right front bottom hinge 30, right back bottom hinge 56, left back bottom hinge 60, left bottom panel hinge 78, and right bottom panel hinge 82.

The front side 14 is divided into a rectangular left front section 41 and a rectangular right front section 42 connected together by a hinged center connector 32. Similarly, the back side 44 is divided into a rectangular right back section 71 and a rectangular left back section 72 connected together by a hinged center connector 62. The connectors 32 and 62 are provided to accommodate the thickness of trapezoids 28, 24, 54, and 58. Further, the left front section 41 and the right front section 42 are further divided by diagonal live hinges 38 and 40 respectively. The diagonal live hinge 38 divides the left front section 41 into a left front triangle 16 and a left front trapezoid 24. The diagonal live hinge 40 divides the right front section 42 into a right front triangle 20 and a right front trapezoid 28. The right back section 71 and the left back section 72 are similarly divided by diagonal living hinges 68 and 70 into trapezoids and triangles. Particularly, the diagonal living hinge 68 divides the right back section 71 into a right back triangle 46 and a right back trapezoid 54. The diagonal live hinge 70 divides the left back section 72 into a left back triangle 50 and a left back trapezoid 58.

Figure 2:
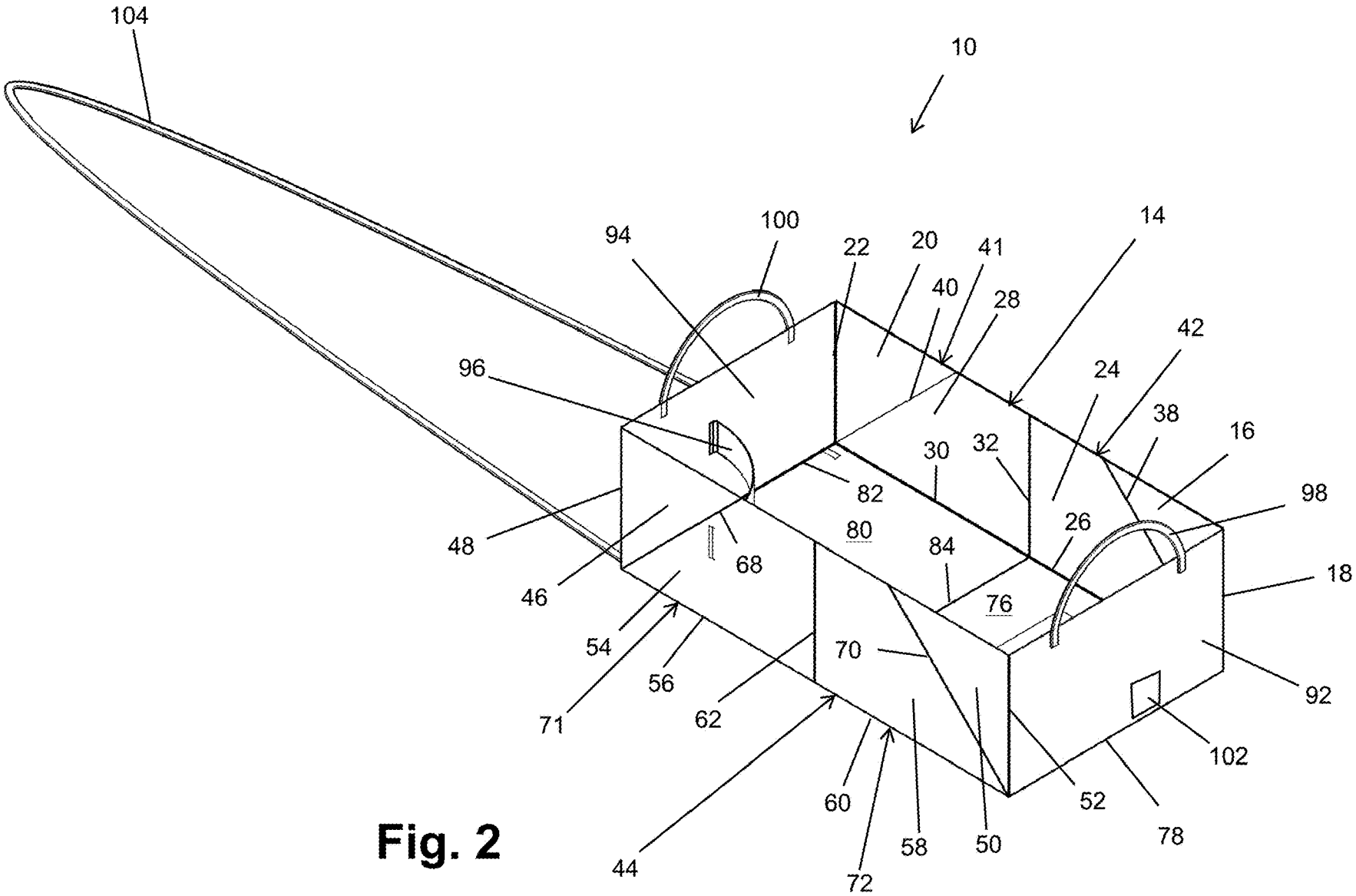
FIG. 2 is a back perspective schematic view of the snack caddy in accordance with the present invention.
Figure 3:
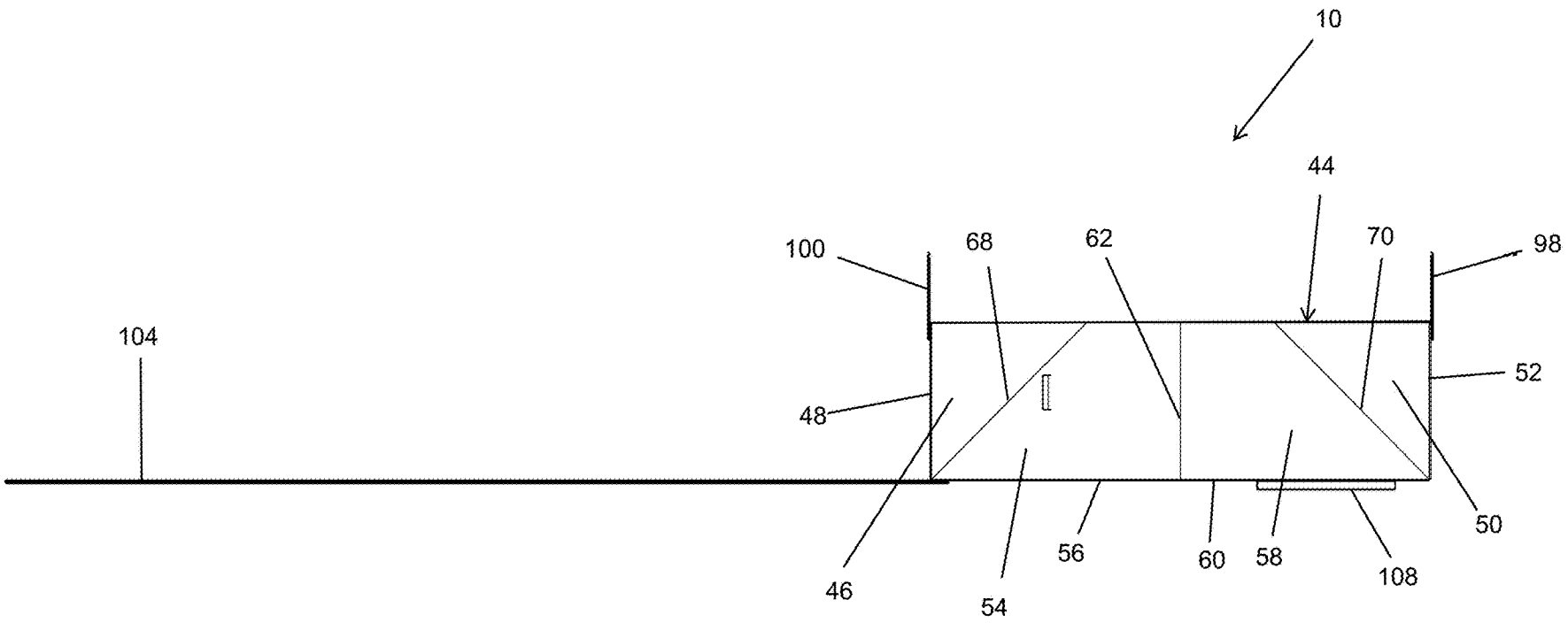
FIG. 3 is a back elevation schematic view of the snack caddy in accordance with the present invention.
Figure 4:
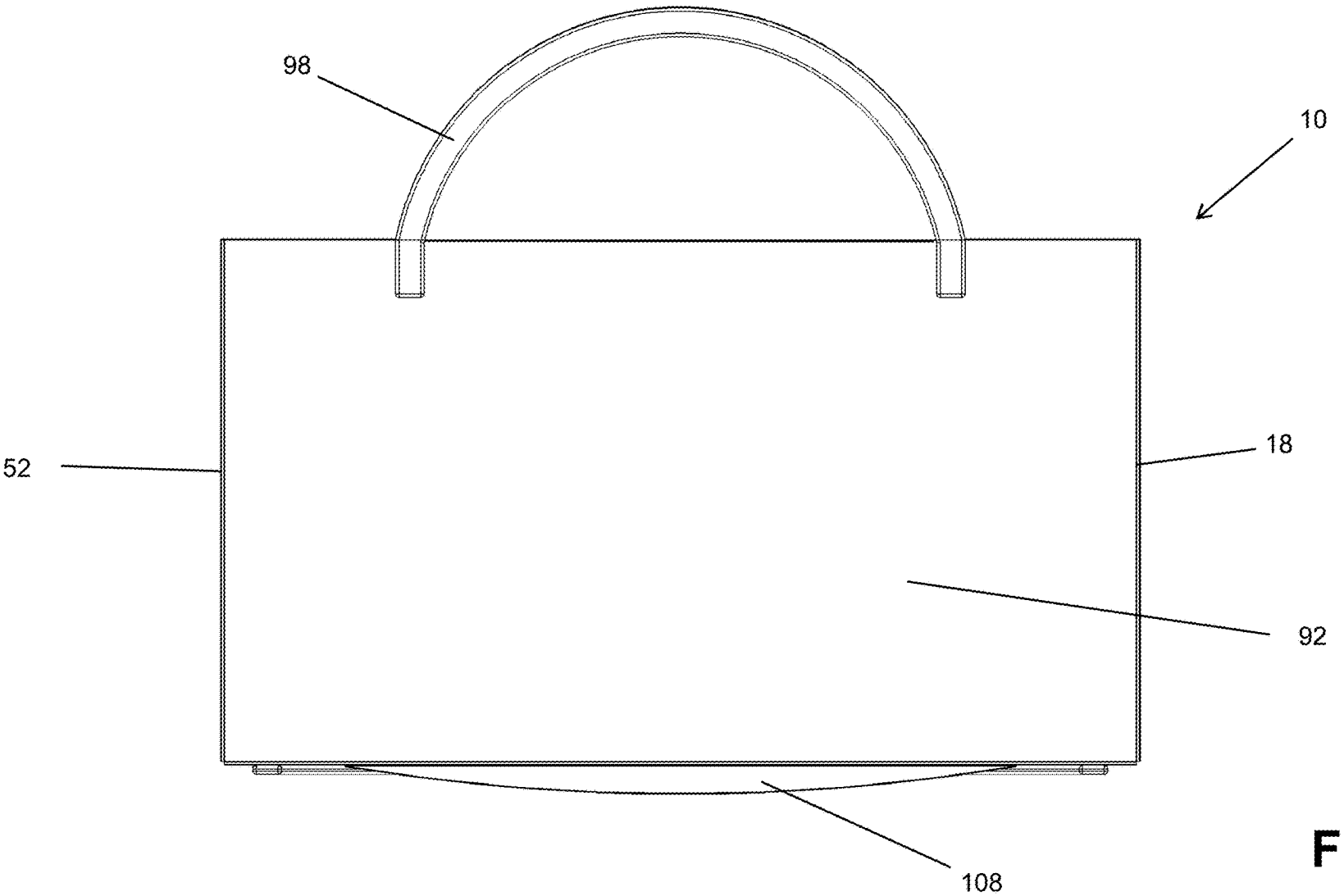
FIG. 4 is a left end elevation schematic view of the snack caddy in accordance with the present invention.
Figure 5:
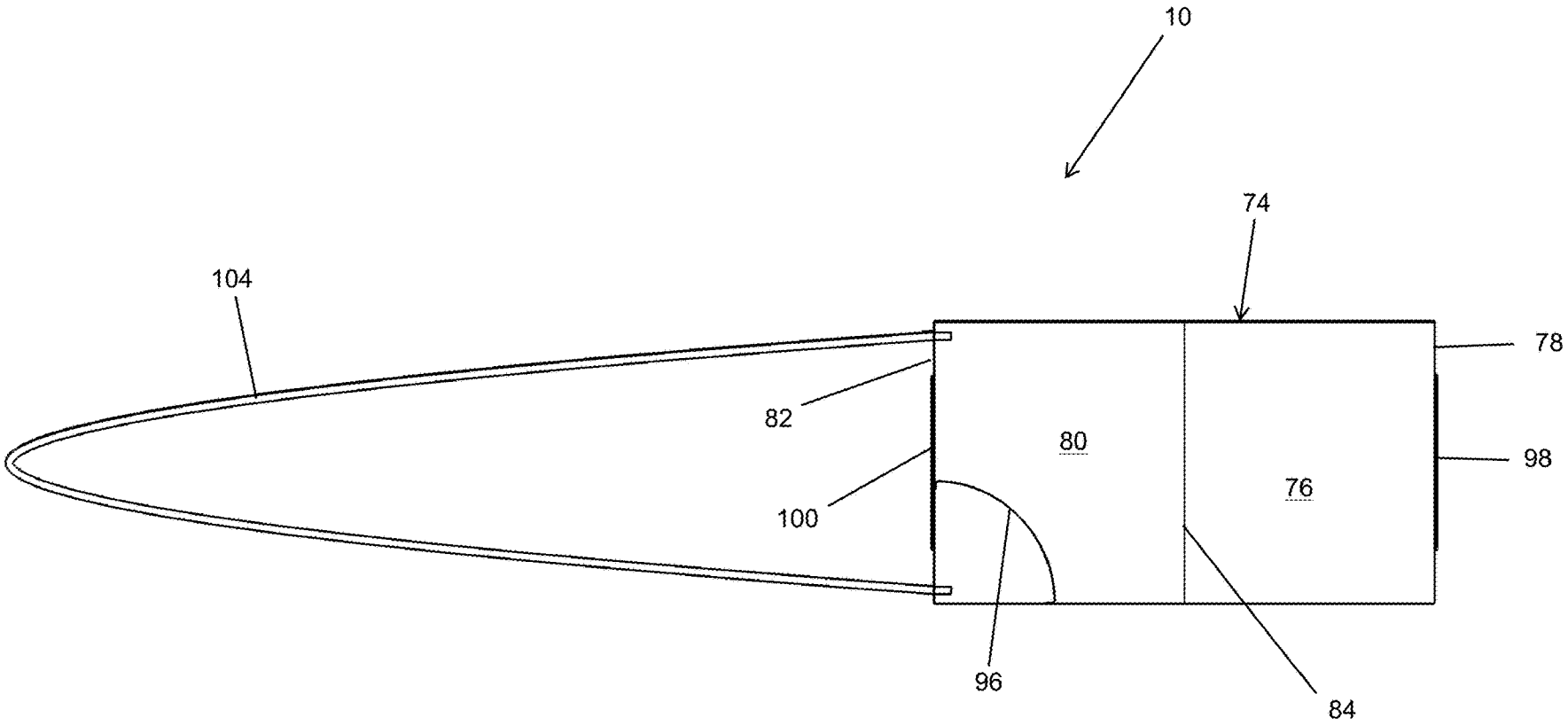
FIG. 5 is a top plan schematic view of the snack caddy in accordance with the present invention.
Figure 6:
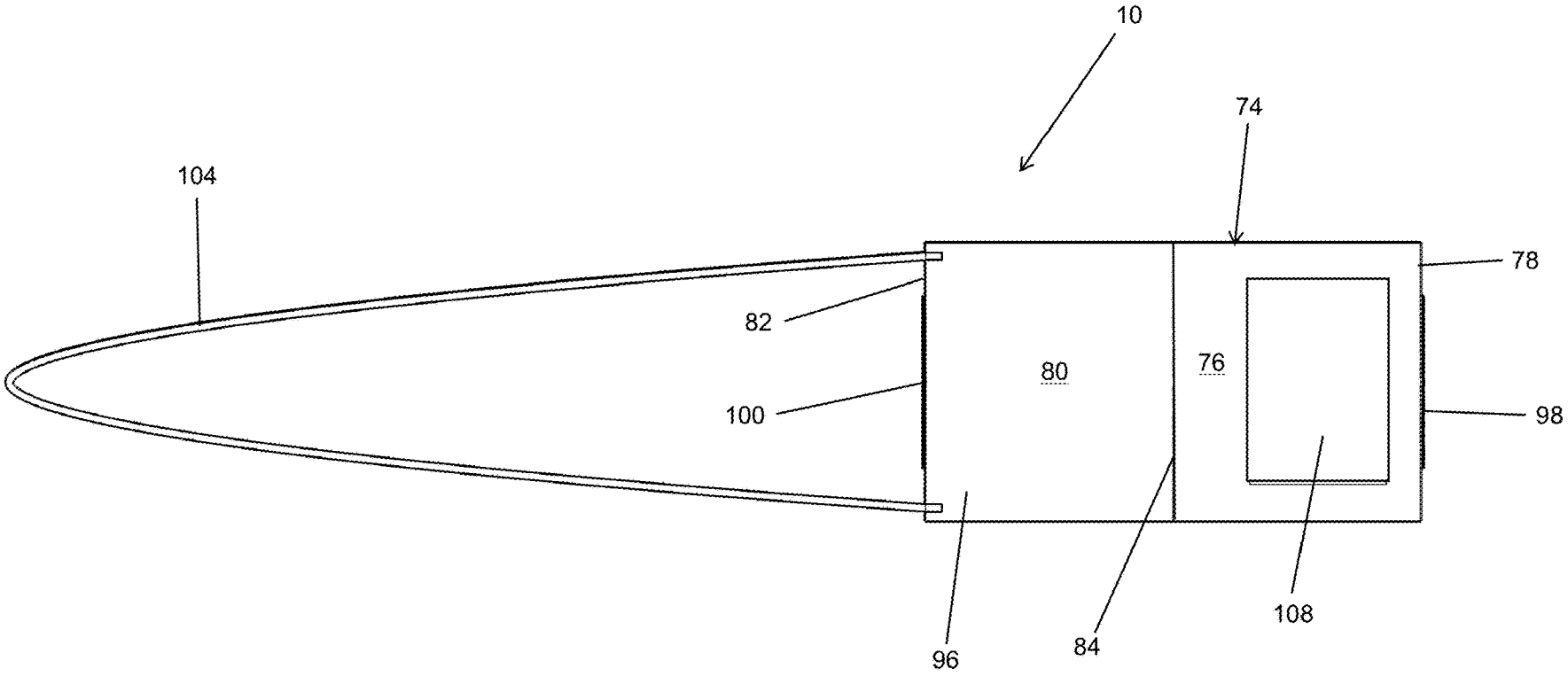
FIG. 6 is a bottom plan schematic view of the snack caddy in accordance with the present invention.

As best shown in FIG. 6, the bottom 74 is divided into a left bottom panel 76 and a right bottom panel 80 connected by a hinged center connector 84. The center connector 84 is provided to accommodate the thickness of bottom panels 76 and 80. A stretchable pocket 108 is provided on the exterior surface of the left bottom panel 76 of the collapsible snack caddy 10 to hold tickets, cell phone, or other flat objects. As shown in FIG. 2, left side foldable handle 98 is attached to left end 92 adjacent the open top, and right side foldable handle 100 is attached to right end 94 adjacent the open top. The handles 98 and 100 facilitate carrying the collapsible snack caddy 10 when filled with snacks and/or drinks.

Figure 1:
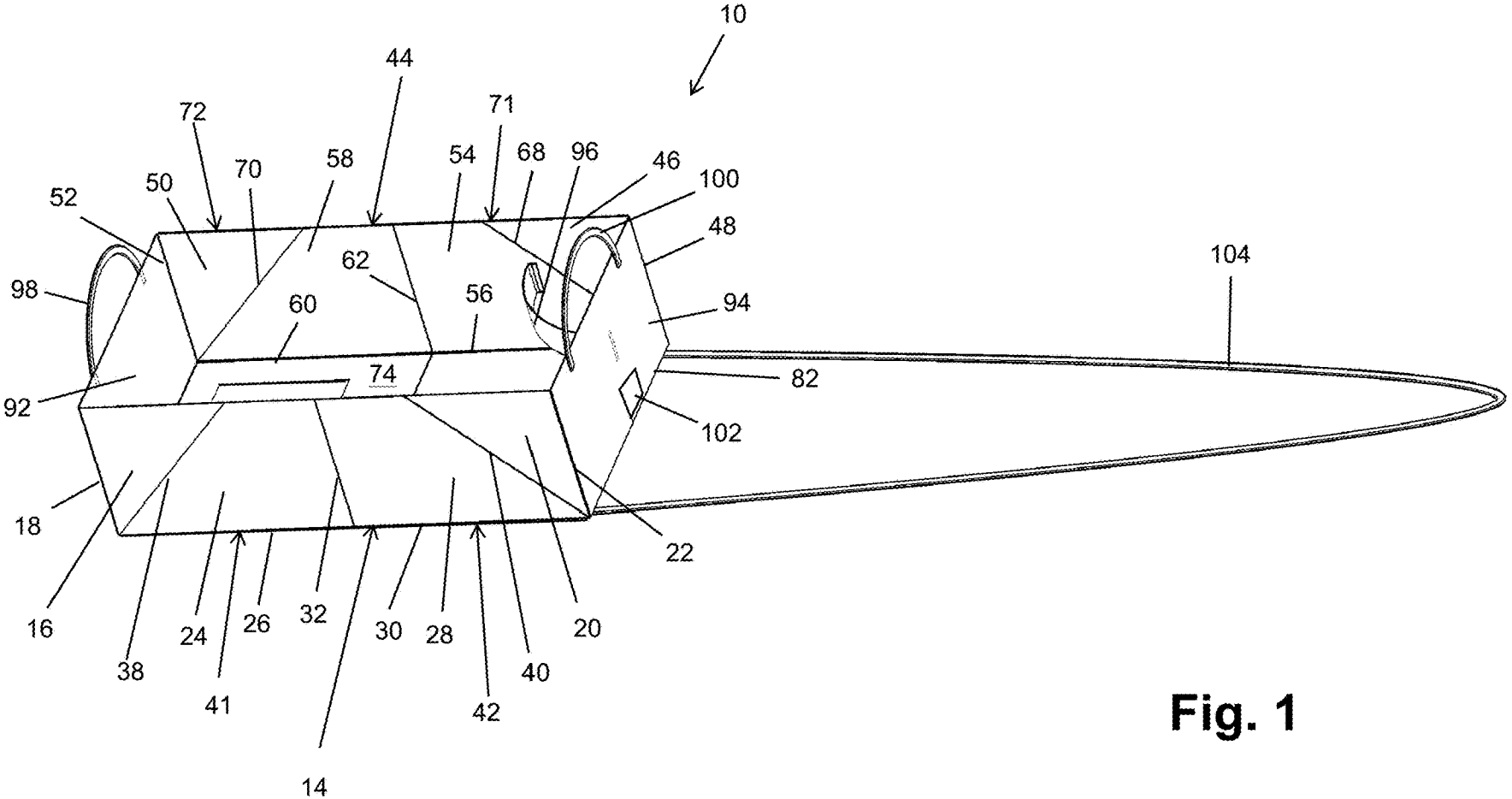
FIG. 1 is a front perspective schematic view of a snack caddy in accordance with the present invention.

As shown in FIGS. 1 and 2, the collapsible snack caddy 10 has one or more flexible drink cup straps, such as drink cup strap 96, inside the collapsible snack caddy 10. The drink cup strap 96 extends the corner of right back corner hinge 48 and is connected between the right end 94 and the right back trapezoid 54 of the box-like structure to secure drink cups to the adjacent sides of the inside corner.

Figure 12:
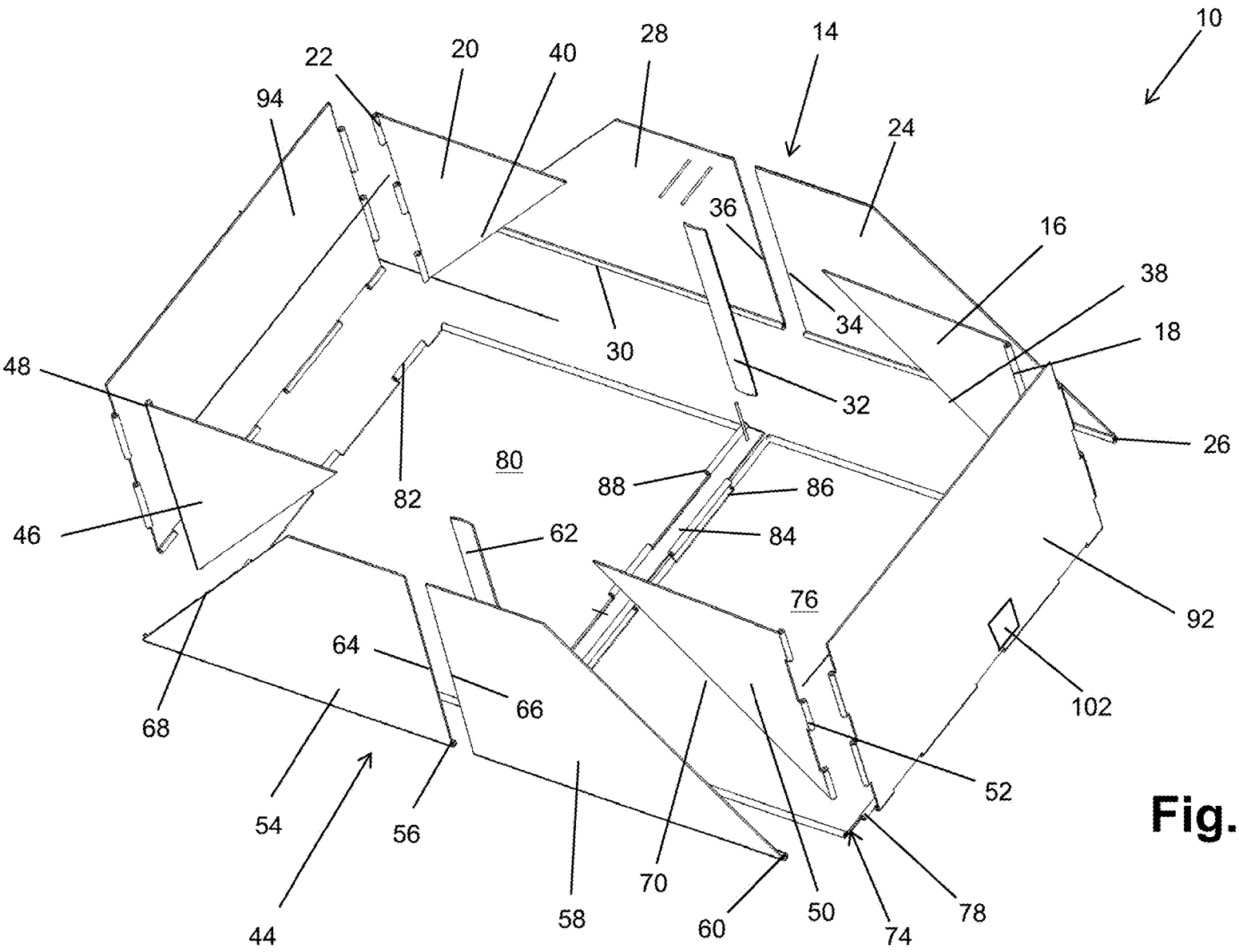
FIG. 12 is a exploded back perspective view of the snack caddy (without a cup strap, carrier handles, or a shoulder strap) in accordance with the present invention.
Figure 13:
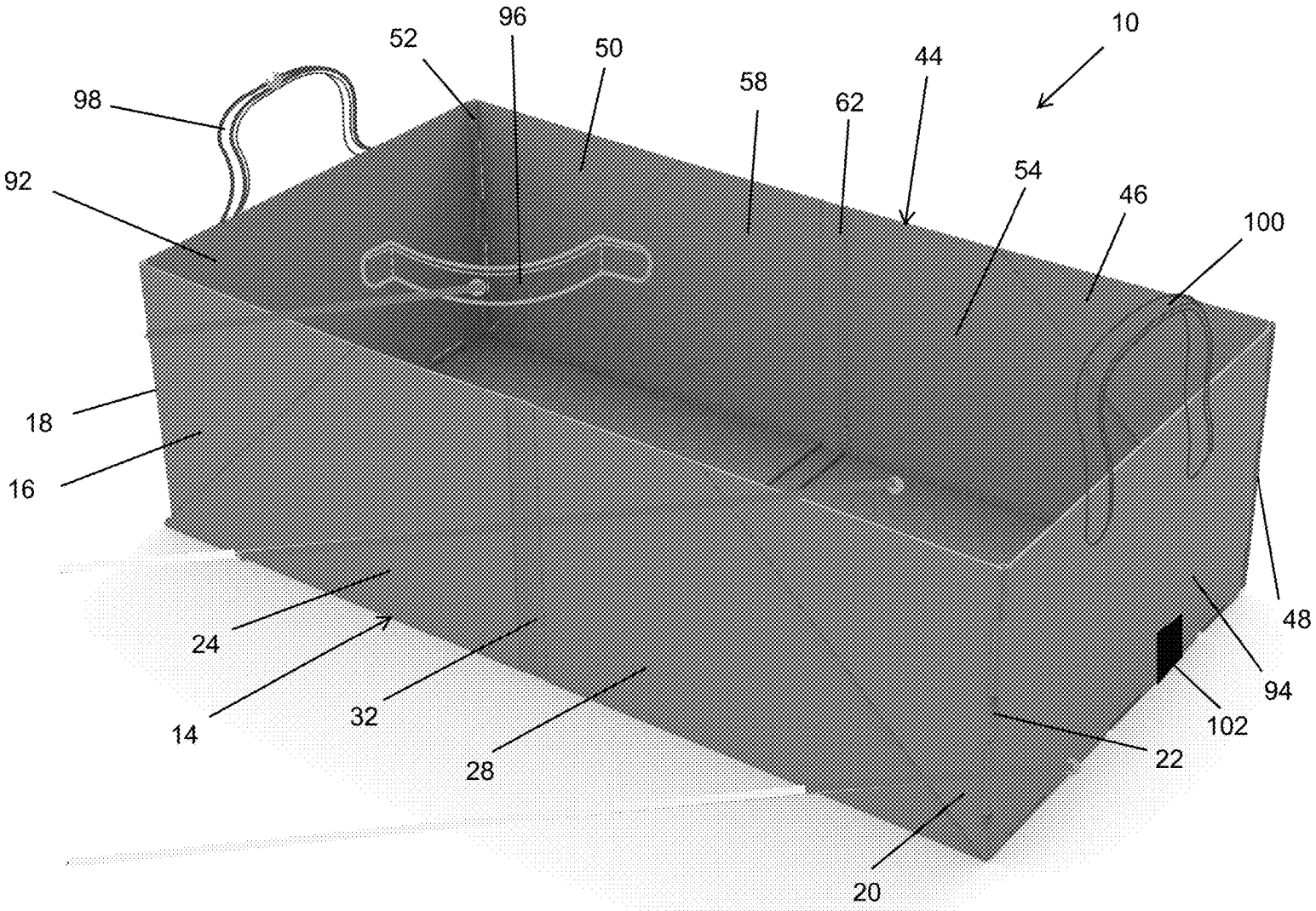
FIG. 13 is a front perspective view of the snack caddy (without a shoulder strap) in accordance with the present invention.

The collapsible snack caddy 10 as configured can be collapsed from a box-like open configuration (FIGS. 1-11 and 13) to a flat configuration (FIGS. 15*f* and 16) when not in use to carry drinks and snacks. FIGS. 7 and 12 show the hinges that allow the collapsible snack caddy 10 to transition from is open configuration to a flat configuration. Particularly, the left back corner hinge 52 and left front corner hinge 18 of the left end 92 allow relative rotational movement between the left end 92 and left front triangle 16 and left back triangle 50. Similarly, right front corner hinge 22 and right back corner hinge 48 of right end 94 allow relative rotational movement between right end 94 and right front triangle 20 and right back triangle 46. The hinges 52, 18, 22, and 48 are piano-type hinges.

The left end 92 and the right end 94 are also connected for relative rotational movement to the left bottom panel 76 and the right bottom panel 80 respectively by left bottom panel hinge 78 and right bottom panel hinge 82. The hinges 78 and 82 are piano-style hinges. The right front trapezoid 28 is connected to the right bottom panel 80 by piano-style right front bottom hinge 30. The left front trapezoid 24 is connected to the left bottom panel 76 by piano-style left front bottom hinge 26. The left back trapezoid 58 is connected to the left bottom panel 76 by piano-style left back bottom hinge 60. The right back trapezoid 54 is connected to the right bottom panel 80 by piano-style right back bottom hinge 56.

With continuing reference to FIGS. 7 and 12, the right back trapezoid 54 and the left back trapezoid 58 are connected together for relative rotation by back center connector 62 engaging right back center connector hinge 64 and left back center connector hinge 66. The left front trapezoid 24 and the right front trapezoid 28 are connected together for relative rotation by front center connector 32 engaging right front center connector hinge 36 and left front center connector hinge 34.

The right bottom panel 80 and left the bottom panel 76 are connected together for relative rotation by bottom center connector 84, piano-type left bottom center connector hinge 86 and piano-type right bottom center connector hinge 88. The bottom center connector 84 is employed to compensate for the thickness of right bottom panel 80 and left bottom panel 76.

The right back triangle 46 and the right back trapezoid 54 are connected together for relative rotation by means of right back living hinge 68. The left back triangle 50 and the left back trapezoid 58 are connected together for relative rotation by means of left back living hinge 70. The right front triangle 20 and the right front trapezoid 28 are connected together for relative rotation by means of right front living hinge 40. The left front triangle 16 and the left front trapezoid 24 are connected together for relative rotation by means of left front living hinge 38.

FIGS. 14 and 15*a*-15*f* show the sequential progression as the collapsible snack caddy 10 progresses from a fully open configuration (FIG. 15*a*) to a fully flat configuration (FIG. 15*f*). As best seen in FIG. 14, the collapsing sequence begins with the front side 14 and back side 44 folding inwardly with the simultaneous rotation of the living hinges 68, 70, 40, and 38, the bottom hinges 56, 60, 30, and 26, and bottom panel hinges 82 and 78. The collapsing sequence progresses until the front side 14, the back side 44, and the ends 92 and 94 lie flat on the bottom 74 (FIG. 15*c*). The bottom 74, the front side 14, and the back side 44 are then folded along the center connectors 32, 84, and 62, and the collapsible snack caddy 10 is retained in its flat position by a closure 102 mounted on the external side of the left end 92 and the external side of the right end 94.

An adjustable shoulder strap 104 can be releasably attached to the exposed exterior surface of the bottom 74 so as seen in FIG. 16, the collapsed snack caddy 10 can be easily carried when not in use.

In the illustrative description of the collapsible snack caddy 10 above, the collapsible snack caddy 10 is illustrated as rectangular in shape with sides that are longer than the ends are wide. As a result, the diagonal living hinges divide the sides into a triangle and a trapezoid shape. The collapsible snack caddy 10 could also be square in shape. With the square shaped collapsible snack caddy, the diagonal living hinges divide the sides into two triangle shapes. Further, for maximum flatness, the height of the sides should not exceed half of the width of the bottom.

One should also appreciate that the use of the terms such as "end", "sides", "top", "bottom", "left", "right", "front", and "back" are for the purposes of part identification and not as an indicator of position or function.

While this invention has been described with reference to preferred embodiments thereof, it is to be understood that variations and modifications can be affected within the spirit and scope of the invention as described herein and as described in the appended claims.

I claim:

1. A collapsible box-like snack caddy having an inside volume comprising:

a. a bottom divided into a first bottom panel and a second bottom panel by a bottom hinge for relative rotation of the first bottom panel and the second bottom panel;

b. a left end connected to the first bottom panel by a left end bottom hinge for relative rotation;

c. a right end connected to the second bottom panel by a right end bottom hinge for relative rotation;

d. a front side divided into a left front section and a right front section by a front side hinge extending across the height of the front side for relative rotation and wherein the left front section is divided diagonally by a left front diagonal hinge extending across the height of the front side and the right front section is divided diagonally by a right front diagonal hinge extending across the height of the front side; and e. a back side divided into a left back section and a right back section by a back side hinge extending across the height of the back side for relative rotation and wherein the left back section is divided diagonally by a left back diagonal hinge extending across the height of the back side and the right back section is divided diagonally by a right back diagonal hinge extending across the height of the back side, wherein corner hinges connect in sequence the left end, the front side, the right end, and the back side for relative rotation allowing the left end, the right end, the front side, and the back side to fold into the inside volume leaving the first bottom panel and the second bottom panel exposed.

2. The snack caddy of claim 1, wherein the snack caddy is rectangular, and the diagonal hinges divide the sides into trapezoids and triangles.

3. The snack caddy of claim 1, wherein the snack caddy is square, and the diagonal hinges divide the sides into triangles.

4. The snack caddy of claim 1, wherein the diagonal hinges are living hinges.

5. The snack caddy of claim 1, further including a drink cup strap within the inside volume of the collapsible snack caddy and extending across one or more of the corners.

6. The snack caddy of claim 1, further including a detachable shoulder strap connected to an outside surface of the bottom.

7. The snack caddy of claim 1, further including a closure to maintain the snack caddy in a flat configuration.

8. The snack caddy of claim 1, wherein the snack caddy has an open top and includes carrier handles attached to the left end and the right end adjacent the open top.

9. The snack caddy of claim 1, further including an exterior pocket attached to an external surface of the back side.

* * * * *